US007207548B1

(12) United States Patent
Howe

(10) Patent No.: US 7,207,548 B1
(45) Date of Patent: Apr. 24, 2007

(54) AUTOMOBILE JACK STAND WITH LIGHTS

(76) Inventor: Richard L. Howe, 209 E. Mitchell Ave., Appleton, WI (US) 54915

( * ) Notice: Subject to any disclaimer, the term of this patent is extended or adjusted under 35 U.S.C. 154(b) by 0 days.

(21) Appl. No.: 11/435,218

(22) Filed: May 16, 2006

(51) Int. Cl.
*B66F 3/08* (2006.01)

(52) U.S. Cl. ..... 254/98; 254/DIG. 1

(58) Field of Classification Search ..... 254/98, 254/93 H, 93 R, DIG. 1, 8 B, 89 H, 122–126
See application file for complete search history.

(56) References Cited

U.S. PATENT DOCUMENTS 3,493,209 A * 2/1970 Brammer ..... 248/352
4,150,813 A 4/1979 Mena
5,118,083 A 6/1992 Metzen
5,165,665 A * 11/1992 Jolivette, Sr. ..... 254/98
5,441,237 A 8/1995 Sweeney
5,915,672 A * 6/1999 Dickey ..... 254/133 R
6,357,724 B1 * 3/2002 Hung ..... 254/8 B
2003/0043581 A1 * 3/2003 Finnigan ..... 362/253

* cited by examiner

*Primary Examiner*—Lee D. Wilson
(74) *Attorney, Agent, or Firm*—Raymond M. Galasso; Galasso & Associates, LP

(57) ABSTRACT

An automobile jack stand having four sides that substantially form a pyramid. Extending from the pyramid is a telecopying support. The telescoping support is attached to a curved horizontal support arm which is the primary point for support. Extending outward from two sides are small support arms which are equipped with light sockets. The light sockets rotate from a horizontal position to a vertical position. The lights are connected to a battery located in the base of the jack and the battery is connected to a electrical cord capable of connecting to an electrical out. The electrical cord functions to recharge the battery.

16 Claims, 3 Drawing Sheets

AUTOMOBILE JACK STAND WITH LIGHTS

FIELD OF THE DISCLOSURE

An automobile jack stand equipped with lights on at least two sides which are connected to a rechargeable battery.

BACKGROUND

Automobile jacks come in varying sizes and shapes. They can be simple little lift jacks for changing a tire on the side of the road or heavy industrial jacks for working on trucks in an automobile garage. They also come in different shapes. Some are simple hand pump jacks and some are more sophisticated hydraulic jacks. What is certain is that at some point every automobile will at some point need to be jacked up whether it is to work on the engine, transmission, muffler or tires.

The most common types of jacks that are carried in the car are for the purpose of changing a tire. Unfortunately, flat tires do not happen during ideal times or under ideal circumstances. They can happen in the dark of night or during the light of day. Sometimes, they even happen during rain and snow storms. Typically, the automobile jack that comes with a car is designed to hook to the bumper or under the edge of car and then is hand pumped to move the car upward and downward. Unfortunately, this type of jack does not lend itself well to hilly conditions or dark conditions. Therefore, if one needed to jack their automobile up in the dark, the are left trying to find a proper spot to hook the jack in the dark. If the jack in not properly installed, then the risk of the automobile falling or the jack tearing up something is greatly increased.

Other automobile jack alternatives include those described in U.S. Pat. No. 4,150,813. In this configuration, the automobile is equipped with a jack system having a plurality of spaced jacks mounted to the vehicle and a hydraulic line connecting pistons included in the jacks so that when pressurized fluid is delivered to the pump a portion will extend and engage with the ground causing the vehicle to raise.

Another alternative is described in U.S. Pat. No. 5,118,083. This particular configuration includes a base plate which is pivotable and therefore allows the jack to be short enough for stowing purposes or getting under low spots of a vehicle.

In U.S. Pat. No. 5,441,237 another vehicle jack is described. This patent describes a jack structure wherein a rigid housing includes a plurality of stacked pneumatic bags within the housing where the stack pneumatic bags are arranged for selective inflation by use of a pneumatic compressor.

While there are number of jacks on the market there are not a lot of different types of jack stands. Jack stands are used to support an object once it has been lifted to the desired height. By using a jack stand, the jack can be removed or used in another position. However, neither the jack or the jack stand are capable of providing any source of light which is beneficial for not only working on a vehicle but particularly important for changing a tire in the dark.

SUMMARY OF THE DISCLOSURE

In one embodiment the jack stand comprises four sides.

In another embodiment the four sides substantially form a pyramid.

In yet another embodiment the jack stand comprises a telescoping support arm located in the center of the pyramid.

In still another embodiment the jack stand telescoping support are is capable of moving upward and downward.

In another embodiment the jack stand comprises a curved horizontal arm.

In still another embodiment the curved horizontal arm is located on top of the telescoping support arm.

In yet another embodiment the horizontal arm functions are the primary contact for supporting an object.

In another embodiment the jack stand comprises two small support arms located on opposite side of the pyramid.

In still another embodiment the two small support arms comprise light sockets.

In yet another embodiment the light sockets are capable of being rotated from a horizontal position to a vertical position.

In another embodiment the jack stand comprises a battery compartment.

In still another embodiment the battery compartment functions to hold at least one battery capable of illuminating the lights.

In yet another embodiment the light sockets function to hold halogen light bulbs.

In another embodiment the battery is comprised of a rechargeable battery.

In still another embodiment the jack stand measures approximately 15 inches in height.

In yet another embodiment the jack stand measures approximately 10 inches in width.

In another embodiment the jack stand measures approximately 10 inches in length.

In still another embodiment the jack stand comprises a base operable to function as a battery compartment.

In yet another embodiment the jack stand comprises a retractable electrical cord located in the base of the stand.

In another embodiment the electrical cord function to connect to an electrical outlet to recharge the battery.

Still other advantages of various embodiments will become apparent to those skilled in this art from the following description wherein there is shown and described preferred embodiments of this invention simply for the purposes of illustration. As will be realized, the invention is capable of other different aspects and embodiments without departing from the scope of the invention. Accordingly, the advantages, drawings, and descriptions are illustrative in nature and not restrictive in nature.

DETAILED DESCRIPTION OF THE DRAWING FIGURES

In the following detailed description of the preferred embodiments, reference is made to the accompanying drawings which form a part hereof, and in which is shown by way of illustration specific preferred embodiments in which the invention may be practiced. These embodiments are described in sufficient detail to enable those skilled in the art to practice the invention, and it is to be understood that other embodiments may be utilized and that logical, mechanical and electrical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

Figure 1:
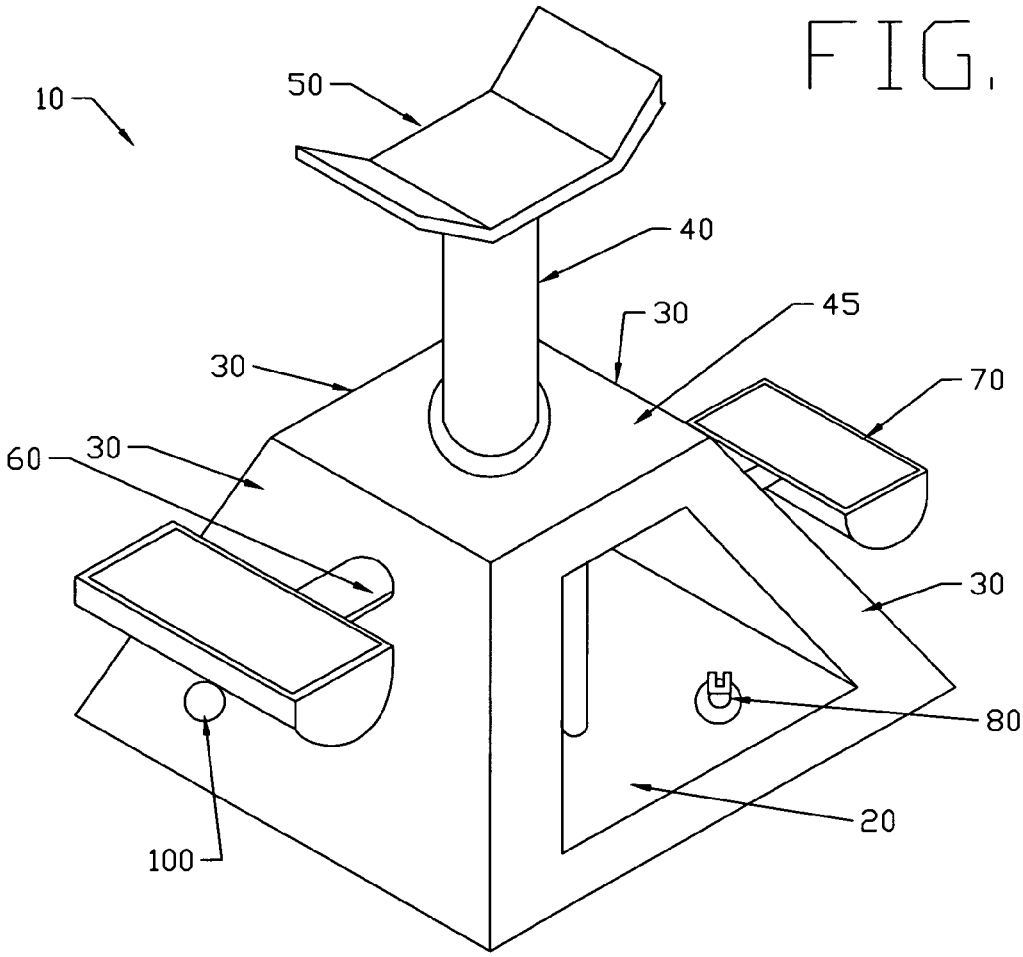
FIG. 1 is a perspective view of a jack stand having lights located on two sides.

FIG. 1 illustrates an automobile jack stand 10 comprising a base 20, four sides 30, a telescoping support arm 40, a top 45, a curved horizontal arm 50, two small support arms 60, light sockets 70, an electrical cord 80 and a battery 90. The four sides 30 extend upward from the base 20 to substantially form a pyramid. Extending from the base 20 is a telescoping support arm 40 which extends upward through the top 45 and attach to the curved horizontal arm 50. The curved horizontal arm 50 functions as the primary point for support. The telescoping support arm 40 is capable of extending upward and downward depending on whether the automobile jack stand 10 is being used for supporting or not. Extending outward from two of the four sides 30 are small support arms 60. The small support arms 60 are connected to light sockets 70. The light sockets 70 are capable of being rotated from a horizontal position to a vertical position. By rotating the lights from the horizontal position to a vertical position, the light can be directed to a particular point for better vision.

Figure 2:
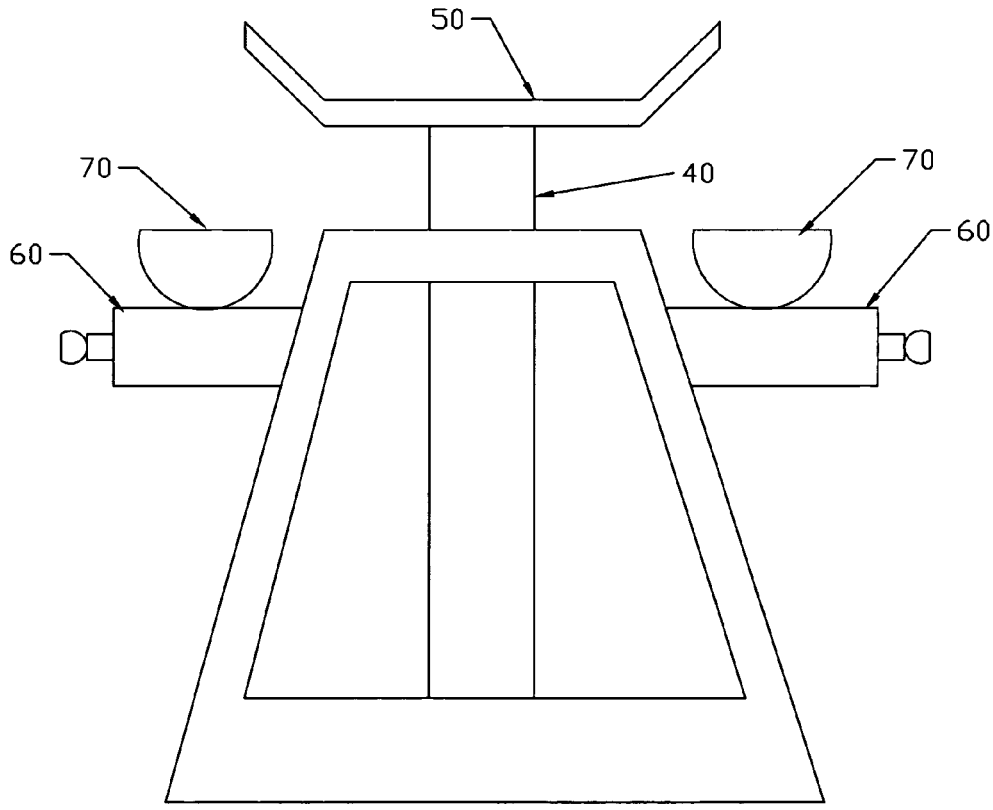
FIG. 2 is a side view of the jack stand described in FIG. 1.

FIG. 2 depicts a side view of the automobile jack stand 10 wherein the small support arms 60 extend outward from two of the four sides 30. The small support arms 60 are equipped with a screw mechanism 100. The screw mechanism 100 functions to hold the light sockets 70 in the desired position. For example, when the light sockets 70 are in a horizontal position, the screw mechanism 100 is tightened to hold them in the horizontal position. In order to rotate the light sockets 70 to a vertical position, the screw mechanism 100 is loosened and the light sockets 70 are rotated. Once the light sockets 70 are rotated to the vertical position, the screw mechanism 100 is again tightened to hold the light sockets 70 in the vertical position.

Figure 3:
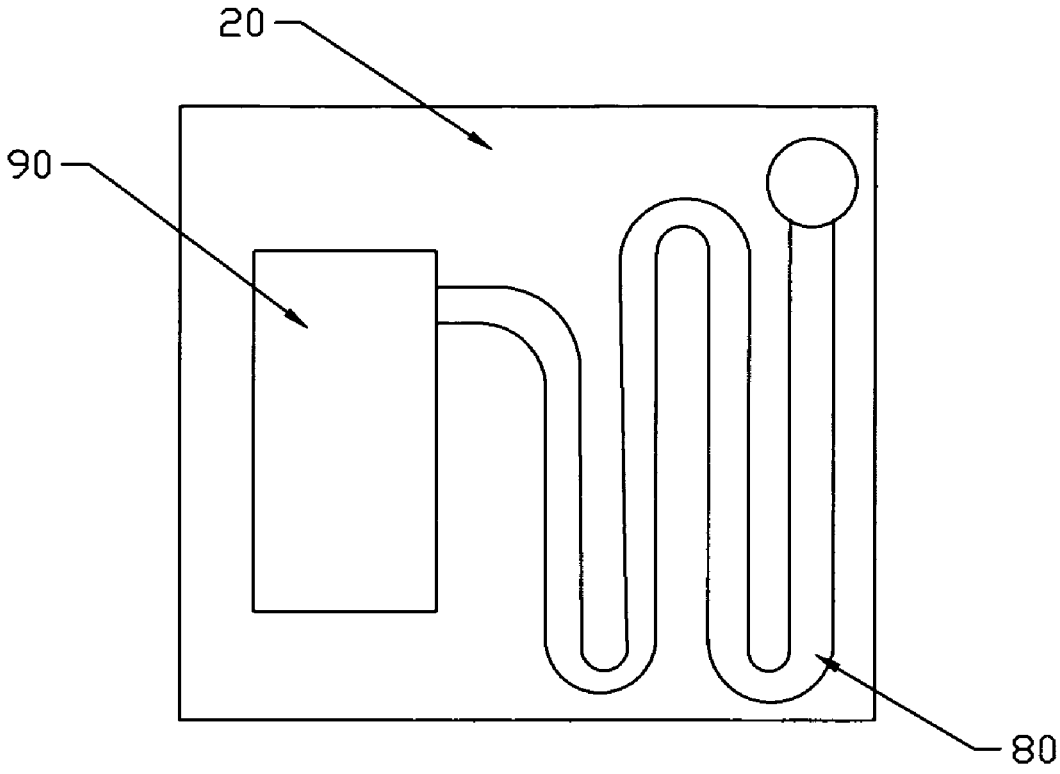
FIG. 3 is a bottom view of the jack stand depicted in FIG. 1.

FIG. 3 is a bottom view of the base 20. The base 20 functions as a holder for the battery 90. The battery 90 is a rechargeable battery which is connected to an electrical cord 80. The electrical cord 80 is capable of extending for connection to an electrical outlet. Once the battery 90 is charged, the electrical cord 80 is retractable. While the present embodiment depicts a rechargeable battery 90, other battery alternatives can be used, even batteries that would need to be replaced. Alternatively, the automobile jack stand 10 could be equipped with an electrical plug that is capable of being plugged into an electrical outlet which would serve as the sole source of electrical current. Another alternative would allow the automobile jack stand 10 to be plugged into a cigarette lighter in an automobile.

Although an embodiment of the present invention has been shown and described in detail herein, along with certain variants thereof, many other varied embodiments that incorporate the teachings of the invention may be easily constructed by those skilled in the art. Accordingly, the present invention is not intended to be limited to the specific form set forth herein, but on the contrary, it is intended to cover such alternatives, modifications, and equivalents, as can be reasonably included within the spirit and scope of the invention.

The invention claimed is:

1. An automobile jack stand comprising:

four sides that substantially form a pyramid;

a telescoping support arm located in the center of said pyramid and capable of moving upward and downward;

a curved horizontal arm located on top of said telescoping support wherein said horizontal arm functions as the primary contact for support;

two small support arms located on opposite sides of said pyramid wherein said support arms include light sockets; and wherein said lights sockets are capable of being rotated from a horizontal to a vertical position; and a battery compartment wherein said battery compartment functions to hold a battery capable of illuminating said lights.

2. The automobile jack stand of claim 1, wherein said light sockets function to hold halogen light bulbs.

3. The automobile jack stand of claim 1, wherein said battery is comprises of a rechargeable battery.

4. The automobile jack stand of claim 1, wherein said stand measures approximately 15 inches in height.

5. The automobile jack stand of claim 1, wherein said stand measures approximately 10 inches in width and approximately 10 inches in length.

6. The automobile jack stand of claim 1, wherein said stand comprises a base operable to function as the battery compartment.

7. The automobile jack stand of claim 1 further comprising a retractable electrical cord located in the base of said stand.

8. The automobile jack stand of claim 7, wherein said electrical cord functions to connect to an electrical outlet and recharge said battery.

9. An automobile jack stand system comprising:

four sides that substantially form a pyramid;

a base connecting said four sides;

a telescoping support arm located in the center of said pyramid and capable of moving upward and downward;

a curved horizontal arm located on top of said telescoping support wherein said horizontal arm functions as the primary contact for support;

two small support arms located on opposite sides of said pyramid wherein said support arms contain light sockets; and wherein said light sockets are capable of being rotated from a horizontal to a vertical position; and a battery compartment wherein said battery compartment functions to hold a battery capable of illuminating said lights.

10. The automobile jack stand system of claim 9, wherein said battery is rechargeable.

11. The automobile jack stand system of claim 9, further comprising an electrical cord capable of connecting to an electrical outlet for recharging said battery.

12. The automobile jack stand system of claim 11, wherein said electrical outlet is retractable into said base.

13. The automobile jack stand system of claim 9, wherein said stand measures approximately 15 inches in height.

14. The automobile jack stand system of claim 9, wherein said stand measures approximately 10 inches in width and 10 inches in height.

15. The automobile jack stand system of claim 9, wherein said light sockets function to hold halogen light bulbs.

16. A method of lighting the underside of a vehicle comprising a jack stand having four sides and substantially forming a pyramid wherein said pyramid includes a telescoping arm located in the center of said stand; a curved horizontal arm for support; two small support arms located on opposites of said stand and having lights located on said small support arms; and a battery compartment having a rechargeable battery comprising the steps of:

placing said stand under an automobile;

placing said curved horizontal arm against said automobile;

rotating the lights on said support arms for increased vision;

lowering said telecoping arm;

removing said jack stand; and recharging said battery.

* * * * *